US005816818A

United States Patent [19]

Wun

[11] Patent Number: 5,816,818

[45] Date of Patent: Oct. 6, 1998

[54] TRAINING DEVICE FOR RIDING A UNICYCLE

[75] Inventor: Shuei-Lian Wun, Taichung, Taiwan

[73] Assignee: Shen Chien Enterprise Co., Ltd., Taichung City, Taiwan

[21] Appl. No.: 909,254

[22] Filed: Aug. 11, 1997

[51] Int. Cl.[6] ..... A63B 69/16

[52] U.S. Cl. ..... 434/29; 434/61; 482/68

[58] Field of Search ..... 434/29, 61, 247; 482/23, 54, 61, 66, 68

[56] References Cited

U.S. PATENT DOCUMENTS

| | | | |
|---|---|---|---|
| 3,580,569 | 5/1971 | Wilson | 482/68 |
| 3,589,717 | 6/1971 | Alexander | 482/66 |
| 3,633,906 | 1/1972 | Fowler | 482/66 |
| 4,572,502 | 2/1986 | Messineo | 482/61 |
| 4,596,386 | 6/1986 | Sackl | 482/61 |
| 4,777,973 | 10/1988 | Nakajima | 482/66 |
| 4,826,150 | 5/1989 | Minoura | 482/61 |
| 4,955,600 | 9/1990 | Hoffenberg et al. | 434/61 |
| 5,026,047 | 6/1991 | Kosecuff | 434/61 |
| 5,042,795 | 8/1991 | Bursik | 482/61 |
| 5,167,597 | 12/1992 | David | 482/68 |
| 5,579,793 | 12/1996 | Gajewski et al. | 482/66 |
| 5,628,711 | 5/1997 | Boucher | 434/61 |

FOREIGN PATENT DOCUMENTS

| | | | |
|---|---|---|---|
| 225034 | 11/1924 | United Kingdom | 482/61 |

*Primary Examiner*—Paul J. Hirsch
*Attorney, Agent, or Firm*—Harrison & Egbert

[57] ABSTRACT

A device for training a person to ride a unicycle including a base for making contact with a floor or ground, two hand rails mounted on the base, and two support rods mounted uprightly on the base such that the two support rods are located between the two hand rails, and that the two support rods are separated from each other by a distance corresponding to the distance between two knobs of the fork tube of the unicycle. The two support rods are provided respectively at the top end thereof with a locating seat having a locating slot for receiving one of the two knobs of the fork tube of the unicycle such that the unicycle can be caused by the rider to engage in a rocking motion.

4 Claims, 7 Drawing Sheets

TRAINING DEVICE FOR RIDING A UNICYCLE

FIELD OF THE INVENTION

The present invention relates generally to a unicycle, and more particularly to a device for training a person to ride the unicycle.

BACKGROUND OF THE INVENTION

The unicycle is generally used in the acrobatic performances for entertainment and is seldom used as an exercise device. It is indeed difficult for most people to balance themselves while straddling a unicycle and pushing the pedals of the unicycle. Generally speaking, most people harbor a phobia of the unicycle, which has prevented the unicycle from being as popular as the bicycle.

SUMMARY OF THE INVENTION

It is therefore the primary objective of the present invention to provide a training device for conditioning a person to ride the unicycle.

In keeping with the principle of the present invention, the foregoing objective of the present invention is attained by a training device, which comprises a base, two hand rails supported by the base, and two support rods each having a slot for locating one of two knobs of the wheel axle of the unicycle.

The foregoing objectives features and functions of the present invention will be more readily understood upon a thoughtful deliberation of the following detailed description of the embodiments of the present invention with reference to the accompanying drawings.

DETAILED DESCRIPTION OF THE EMBODIMENTS

Figure 1:
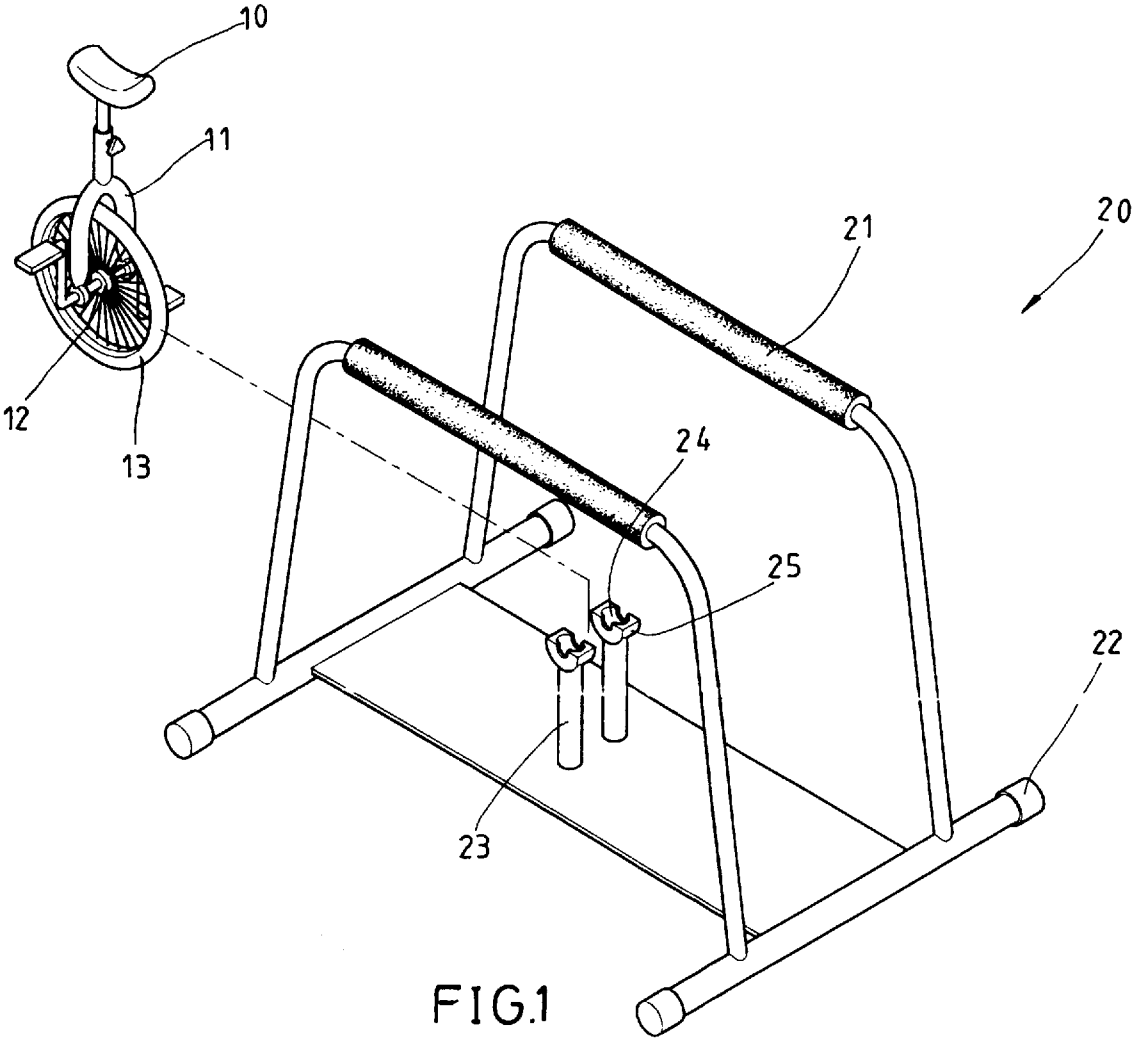
FIG. 1 shows a perspective view of the present invention in conjunction with a unicycle.
Figure 2:
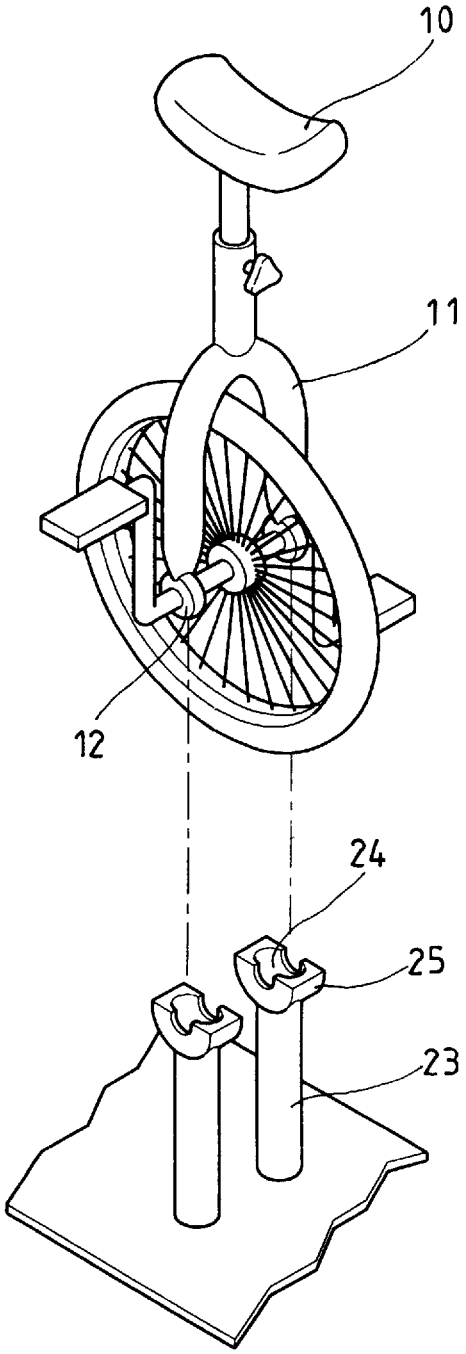
FIG. 2 shows a partial perspective view of the present invention in conjunction with the unicycle.
Figure 3:
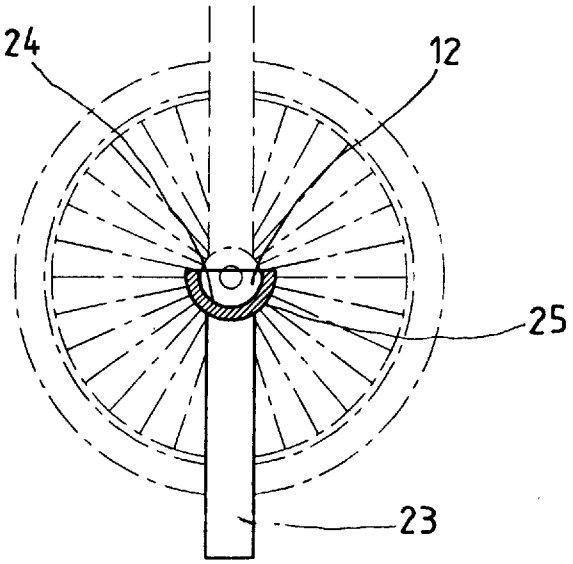
FIG. 3 shows a partial sectional view of the present invention.
Figure 4:
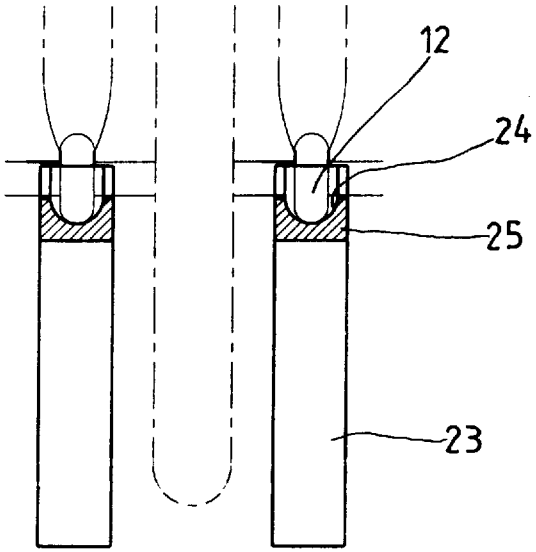
FIG. 4 shows another partial sectional view of the present invention.

As shown in FIGS. 1–7, a training device 20 embodied in the present invention is intended for use in training a person to ride a unicycle and is composed of a base 22, two hand rails 21, and two support rods 23 for supporting a unicycle 10.

The two support rods 23 are uprightly supported on the base 22 such that they are separated from each other at an interval. The two support rods 23 are provided respectively at the top end (free end) thereof with a locating seat 25 having a locating slot 24 for locating one of two knods 12 of the fork tube 11 of the unicycle 10. The knobs 12 are fastened with the axle of the wheel 13 of the unicycle 10 such that the knobs 12 are separated from each other by the hub of the wheel 13 of the unicycle 10.

In operation, the unicycle 10 is supported on the two support rods 23 such that the knobs 12 of the unicycle 10 are received in the locating slots 24 of the locating seats 25. The rider pedals while both hands of the rider hold the hand rails 21.

Figure 6:
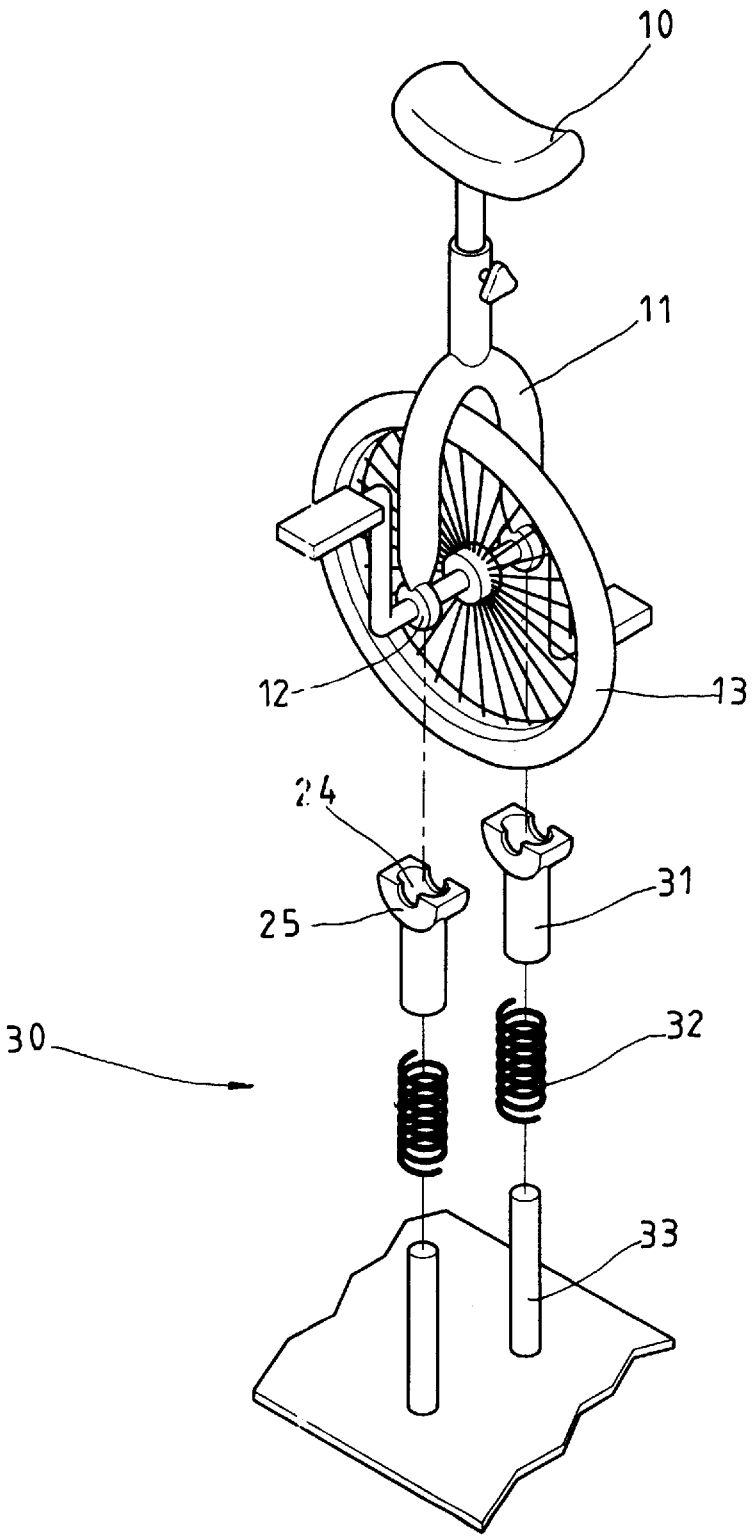
FIG. 6 shows a partial exploded view of the present invention.

As shown in FIG. 6, the support rods 30 of the training device 20 of the present invention may be modified in construction such that each of the two support rods 30 is composed of a locating rod 31, a coil spring 32, and a guide rod 33 which is mounted uprightly on the base 22 of the training device 20. In combination, the coil spring 32 is fitted over the guide rod 33, whereas the bottom end of the locating rod 31 is supported by the upper end of the coil spring 32. The locating rod 31 is provided at the top end thereof with a locating seat 25 having a locating slot 24 for receiving the knob 12 of the fork tube 11 of the unicycle 10.

Figure 5:
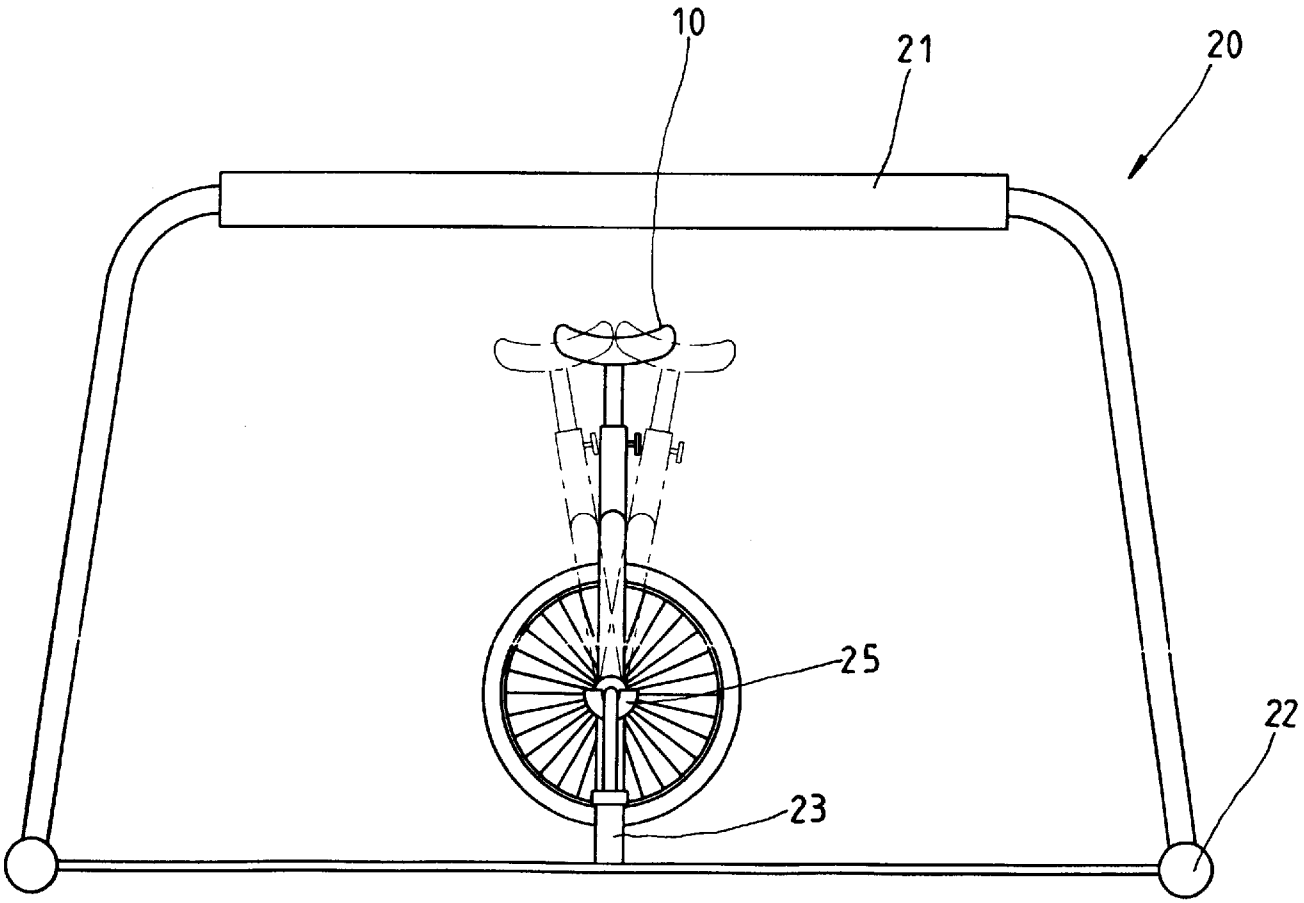
FIG. 5 shows a schematic view of the present invention at work.
Figure 7:
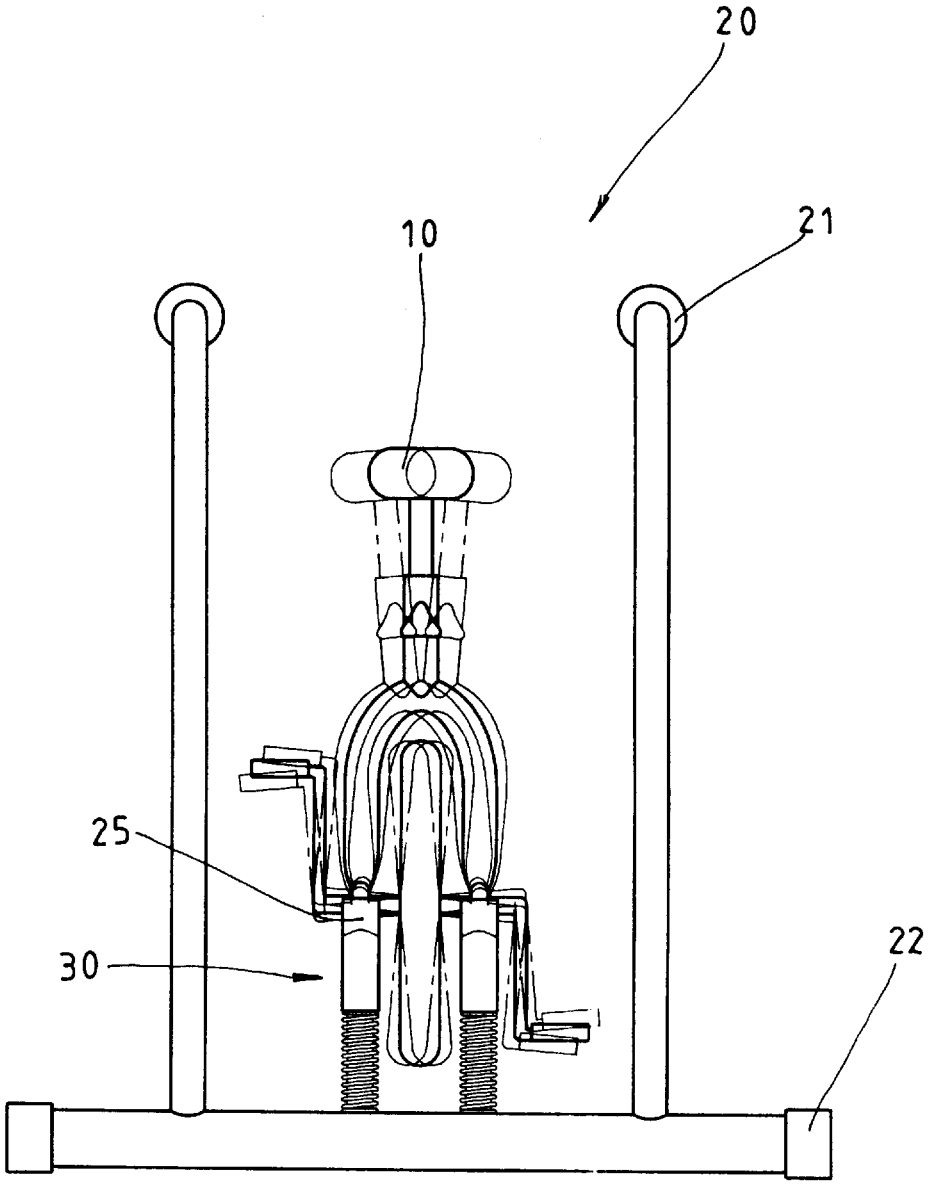
FIG. 7 shows a schematic view of the present invention at work.

As illustrated in FIG. 7, the modified support rods 30 of the present invention enable the rider of the unicycle 10 to engage in the left-and-right rocking movement while pedaling the unicycle 10. On the other hand, the support rods 23 of the first preferred embodiment of the present invention enable the rider of the unicycle 10 to engage in the back-and-forth rocking movement while pedaling the unicycle 10, as illustrated in FIG. 5.

Figure 8:
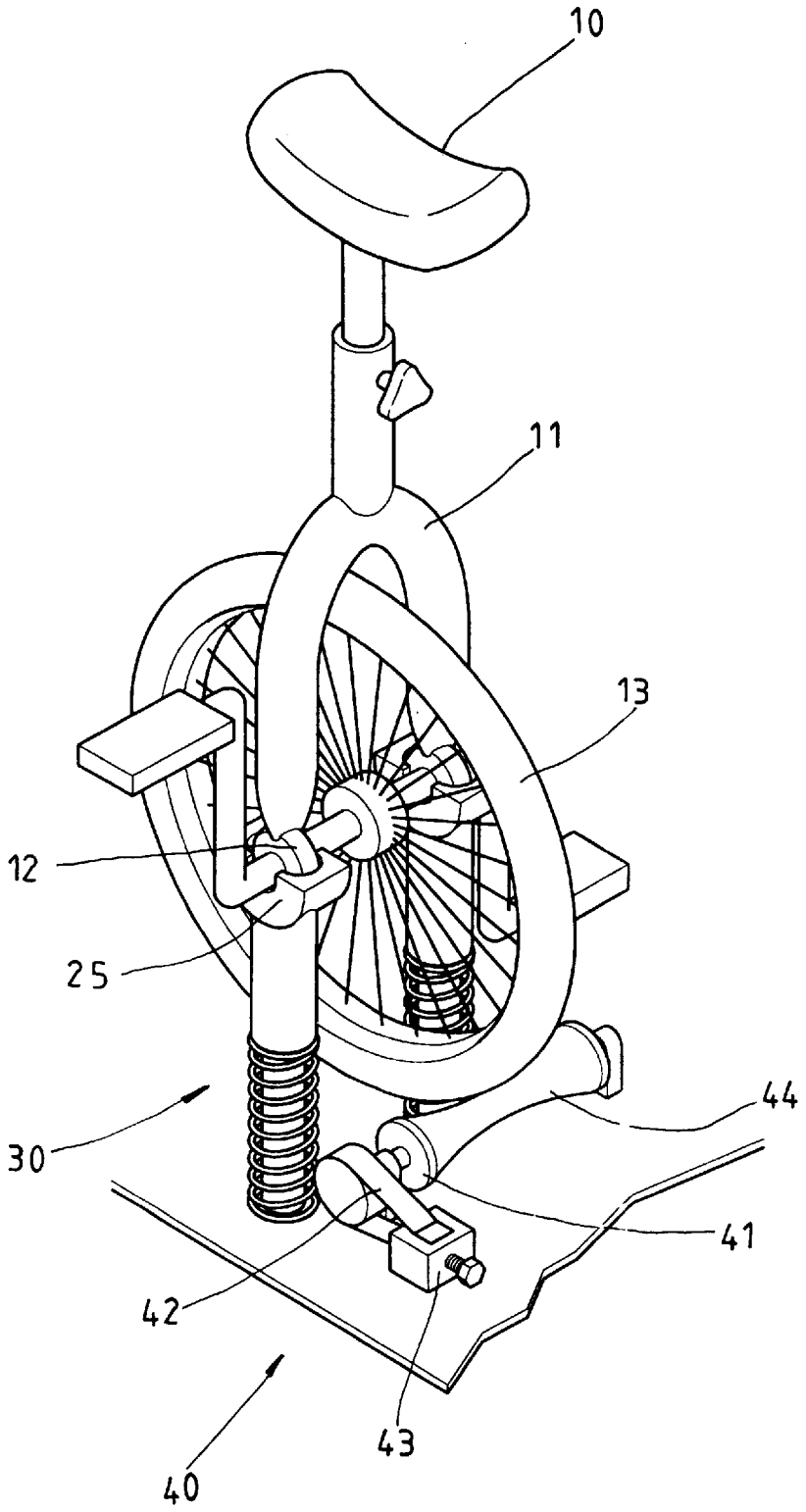
FIG. 8 shows a schematic view of another embodiment of the present invention.

The training device 20 of the present invention may be further modified such that the base 22 of the device 20 is provided with a damping device 40 mounted thereon, as illustrated in FIG. 8. The damping device 40 includes a rotary shaft 41, a control belt 42, and an adjustment member 43. The rotary shaft 41 is provided with a curved friction surface 44 and is mounted on the base 22 such that the curved friction surface 44 makes contact with the wheel 13 of the unicycle 10. In other words, the rider of the unicycle 10 must make a serious physical effort to overcome the mechanical friction between the wheel 13 and the curved friction surface 44 of the damping device 40 so as to be able to pedal the unicycle 10. As a result, the training device 20 of the present invention can be used as an exercise machine in conjunction with the unicycle 10. It must be noted here that the rotary shaft 41 is fastened at one end thereof with the control belt 42 which is in turn fastened with the adjustment member 43. The magnitude of the damping effect of the damping device 40 can be adjusted by the adjustment member 43 such that the control belt 42 can be either tightened or loosened, thereby resulting in an increase or a decrease in the mechanical friction force between the curved friction surface 44 and the wheel 13 of the unicycle 10.

The embodiments of the present invention described above are to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A training device for riding a unicycle, said training device comprising:

a base;

two hand rails mounted on said base such that said two hand rails are separated from each other at an interval, and that said two hand rails can be easily reached by both hands of a rider of a unicycle; and two support rods mounted uprightly on said base such that said two support rods are located between said two hand rails and that said two support rods are separated from each other at an interval corresponding to a distance between two knobs located at both ends of a fork tube of the unicycle, said two support rods provided respectively at a top end thereof with a locating seat having a locating slot for receiving one of the two knobs of the fork tube of the unicycle such that the unicycle can be caused by the rider to engage in a back-and-forth rocking movement, said two support rods are each comprised of a locating rod, a biasing means, and a guide rod fastened uprightly bottom end thereof with said base such that said biasing means is fitted over said guide rod, said locating rod is supported at a bottom end thereof by a top end of said biasing means, said biasing means for allowing the rider to engage in a left-and-right rocking movement of the unicycle.

2. The training device as defined in claim 1, wherein said biasing means is a coil spring.

3. The training device as defined in claim 1, wherein said base is provided with a damping means mounted thereon for bringing about a mechanical friction to resist motion of a wheel of the unicycle.

4. The training device as defined in claim 3, wherein said damping means comprises a rotary shaft, a control belt fastening one end of said rotary shaft to control the rotational speed of said rotary shaft, and an adjustment member capable of tightening or loosening said control belt, said rotary shaft having a friction surface for making contact with the wheel of the unicycle such that a resistance is brought about by the friction surface against the wheel in motion.

* * * * *